US007108000B2

(12) United States Patent
Lagace

(10) Patent No.: US 7,108,000 B2
(45) Date of Patent: Sep. 19, 2006

(54) WASHER PRESSURE EQUALIZATION SYSTEM

(75) Inventor: Francois Lagace, Charlesbourg (CA)

(73) Assignee: STERIS Inc., Temecula, CA (US)

( * ) Notice: Subject to any disclaimer, the term of this patent is extended or adjusted under 35 U.S.C. 154(b) by 439 days.

(21) Appl. No.: 10/606,292

(22) Filed: Jun. 25, 2003

(65) Prior Publication Data

US 2004/0261825 A1 Dec. 30, 2004

(51) Int. Cl.
*B08B 3/02* (2006.01)

(52) U.S. Cl. ..... 134/98.1; 134/103.1; 134/107

(58) Field of Classification Search ..... 134/94.1, 134/95.2, 98.1, 103.1, 111, 107
See application file for complete search history.

(56) References Cited

U.S. PATENT DOCUMENTS

| | | | | |
|---|---|---|---|---|
| 3,785,387 A | | 1/1974 | Ross | 134/95 |
| 3,786,825 A | | 1/1974 | Weisner | 134/99 |
| 4,195,419 A | | 4/1980 | Quayle | 34/231 |
| 4,226,642 A | | 10/1980 | Baran | 134/10 |
| 4,285,219 A | * | 8/1981 | Grunewald | 68/19.2 |
| 4,820,351 A | | 4/1989 | Hambleton et al. | 134/21 |
| 5,113,882 A | * | 5/1992 | Gileta | 134/19 |
| 5,288,467 A | * | 2/1994 | Biermaier | 422/116 |
| 5,457,897 A | * | 10/1995 | Becker | 34/472 |
| 5,464,483 A | | 11/1995 | Avelis et al. | 134/25.4 |
| 5,546,771 A | | 8/1996 | Bonar | 68/4 |
| 6,021,788 A | | 2/2000 | King | 134/25.2 |
| 6,090,213 A | | 7/2000 | Moyers | 134/1 |
| 2002/0159917 A1 | | 10/2002 | Swart et al. | 422/20 |
| 2002/0173437 A1 | | 11/2002 | Rabon et al. | 510/161 |
| 2003/0036272 A1 | * | 2/2003 | Shamouilian et al. | 438/691 |
| 2003/0133834 A1 | | 7/2003 | Karle | 422/33 |

* cited by examiner

*Primary Examiner*—Joseph L. Perrin
(74) *Attorney, Agent, or Firm*—Kusner & Jaffe; Michael A. Centanni

(57) ABSTRACT

A system for equalizing pressure in a washing chamber in response to changes in pressure inside washing chamber. Gate elements are operable between open and closed positions to regulate pressure conditions inside the washing chamber.

10 Claims, 4 Drawing Sheets

WASHER PRESSURE EQUALIZATION SYSTEM

FIELD OF THE INVENTION

The present invention relates generally to a system for regulating fluid flow, and more particularly to a system for equalizing pressure in a washing chamber.

BACKGROUND OF THE INVENTION

Large industrial washers are commonly used in the healthcare, pharmaceutical, and scientific research industries. The washers are used to remove contaminants and biological waste from large objects, such as racks of animal cages, and healthcare and scientific equipment, such as hospital beds, wheelchairs, medical instruments, utensils, carts, instrument containers, and the like. The washer includes a washing chamber with a large opening for providing access to the washing chamber. A door seals the opening, and opens to allow a load to be located inside the washing chamber. The washing chamber may be over six feet tall and several feet wide and deep to accommodate the aforementioned items.

Since the fluids used within such washing chambers are often heated, significant fluctuations in pressure can occur within the washing chamber during a washing cycle. More specifically, considerable differences in temperature in liquids and gases (e.g., air) used during a washing cycle or during an exhaust or drying cycle, can produce either an increased pressure in the washing chamber as compared to the surrounding environment (i.e., a positive pressure), or a vacuum in the washing chamber as compared to the surrounding environment (i.e., a negative pressure). Moreover, in the event of a vacuum condition within the washing chamber, it is important that "unfiltered air" not be drawn into the chamber, as this would allow contaminants to enter the washing chamber, and thus impair the effectiveness of the washer.

The present invention provides a pressure equalization system that prevents large fluctuations in pressure in a washing chamber.

SUMMARY OF THE INVENTION

In accordance with the present invention, there is provided a washer including a washing chamber and an intake assembly having a first blower, a pressure equalization system operable to maintain an equalized pressure in the washing chamber, said pressure equalization system comprising: (a) a first gate element movable between an open position and a closed position, said first gate element disposed between said first blower and said washing chamber; and (b) a second gate element movable between an open position and a closed position, said second gate element disposed between said first blower and said first gate element, wherein said first gate element and said second gate element are movable to the open position in response to a negative pressure condition in said washing chamber to increase the pressure therein.

An advantage of the present invention is the provision of a pressure equalization system having pressure relief means to compensate for pressure variations within a washing chamber.

Another advantage of the present invention is the provision of a pressure equalization system that prevents unfiltered air from entering the washing chamber.

A still further advantage of the present invention is the provision of a pressure equalization system that provides a fully integrated air drying and pressure regulation system.

Still another advantage of the present invention is the provision of a pressure equalization system that can be implemented for a relatively low cost.

Yet another advantage of the present invention is the provision of a washer including a pump that progressively increases and decreases fluid flow into a washing chamber.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF A PREFERRED EMBODIMENT

Figure 1:
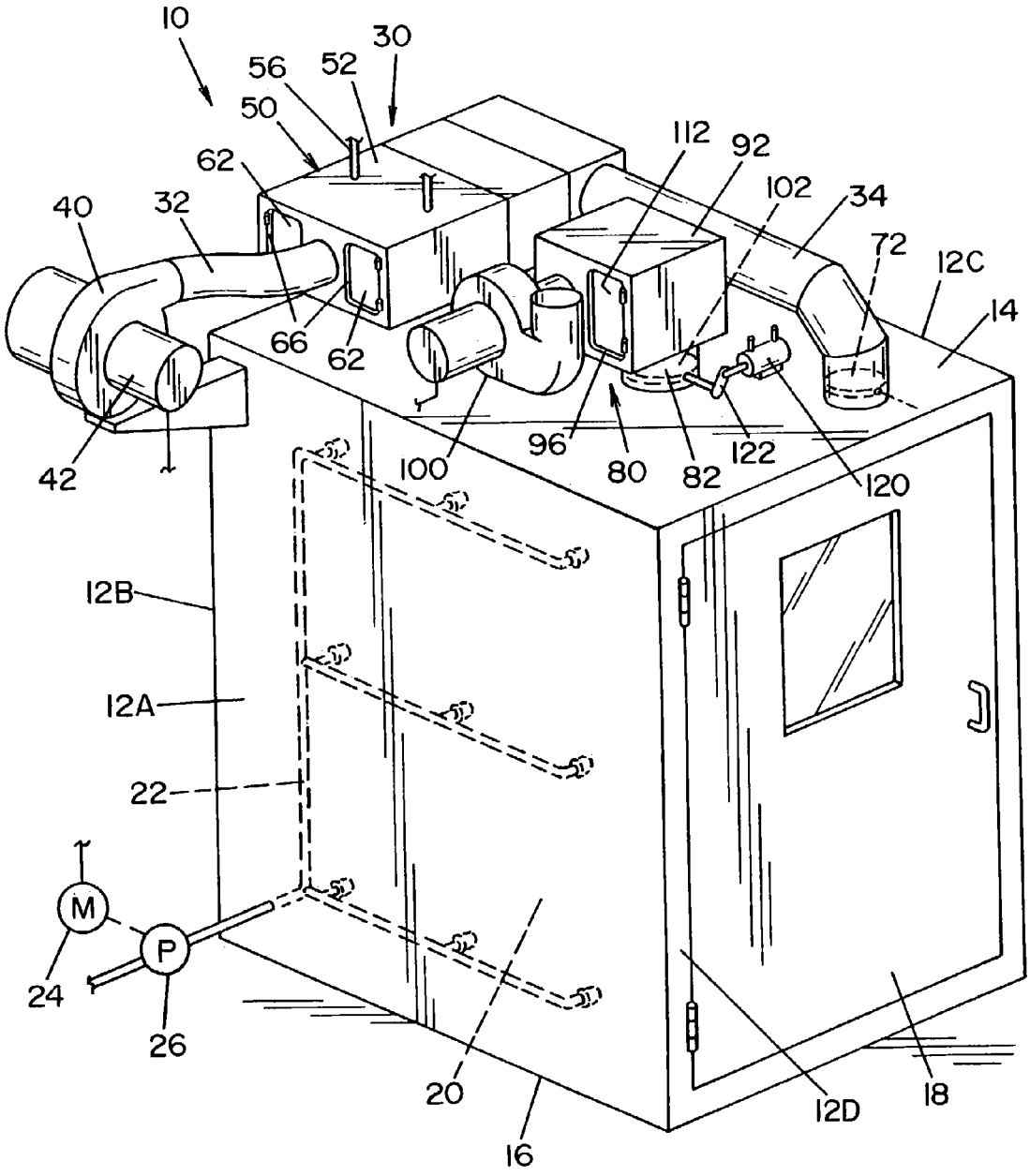
FIG. 1 is a perspective view of a conventional large washer for removing contaminants and biological waste from large objects.

Referring now to the drawings wherein the showings are for the purposes of illustrating a preferred embodiment of the invention only and not for purposes of limiting same, FIG. 1 is a perspective view of a washer 10, according to a preferred embodiment of the present invention. Washer 10 includes an air intake assembly 30, an air exhaust assembly 80, and a washing chamber 20. Side walls 12A, 12B, 12C and 12D, top wall 14, and floor 16 define washing chamber 20. An opening, sealed by a door 18, is provided in side wall 12D to provide access to washing chamber 20. A recirculation pump 26, driven by a motor 24, pumps fluids through washing chamber 20 via a plumbing network 22, in a manner well known to those skilled in the art. The fluids delivered into washing chamber 20 via plumbing network 22 are typically conventional cleaning, deactivation, and rinsing fluids. In some cases, the fluids may be heated to temperatures above room temperature.

Figure 2:
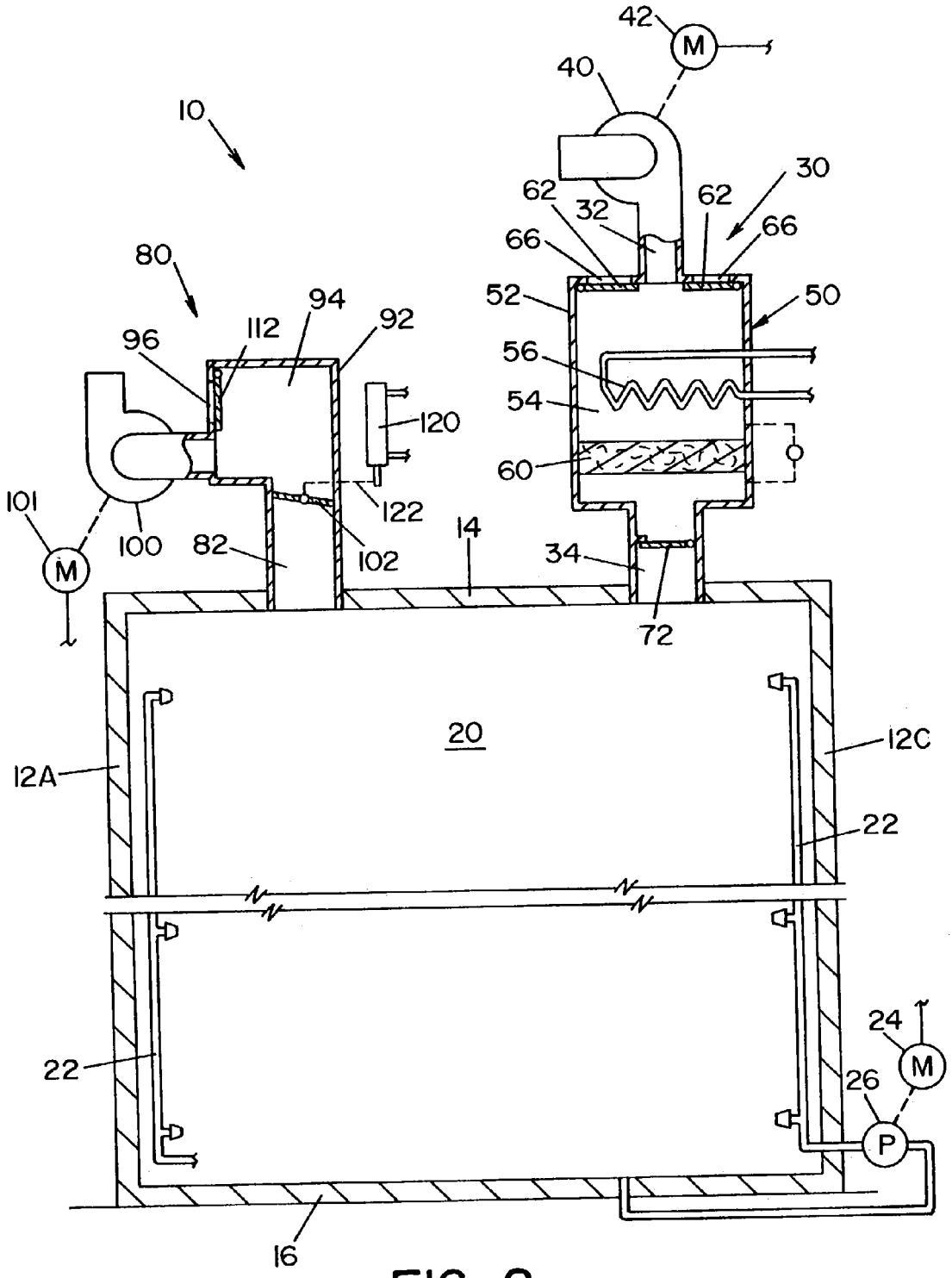
FIG. 2 is a cross-sectional schematic view of a washer according to a preferred embodiment of the present invention.

Referring now to FIG. 2, there is shown a cross-sectional schematic view of washer 10. Air intake assembly 30 includes an input blower 40, a first input conduit 32, a second input conduit 34, and a heater assembly 50. Blower 40 is powered by a motor 42. Blower 40 may optionally include a filter element (not shown) to filter air drawn into blower 40 from the surrounding environment. Heater assembly 50 includes a housing 52 that is disposed between conduit 32 and conduit 34. Housing 52 defines a heating chamber 54. Heater assembly 50 also includes a heating element 56 disposed inside heating chamber 54. In a preferred embodiment, heating element 56 is an electric or steam heating element. Conduit 32 communicates with the output of blower 40 and heating chamber 54. Conduit 34 communicates with heating chamber 54 and washing chamber 20. A filter element 60 is disposed inside heating chamber 54 between heating element 56 and conduit 34. All air passing from heating chamber 54 into conduit 34 must pass through filter element 60 to remove contaminants therein. In the illustrated embodiment, filter element 60 is an electronic or electrostatic filter.

Air exhaust assembly 80 includes an output conduit 82, an exhaust housing 92, and an exhaust blower 100, powered by a motor 101. Exhaust housing 92 is disposed between the input to blower 100 and conduit 82. Exhaust housing 92 defines an exhaust chamber 94. Exhaust chamber 94 is in communication with the input to blower 100 and conduit 82. Conduit 82 is in communication with exhaust chamber 94 and washing chamber 20.

A pressure equalization system is comprised of a plurality of gate elements arranged in air intake assembly 30 and air exhaust assembly 80. The gate elements are movable between an open position and a closed position. In a preferred embodiment, pressure equalization system includes gate elements in the form of valves 62, 72, 102 and 112. Valves 62, 72 and 112 are preferably pressure-actuated flap valves, spring-biased to a normally closed position. Valves 62, 72, and 112 are operable to move between the open and closed positions in response to pressure conditions, as will be explained below.

It should be appreciated that in an alternative embodiment of the present invention, valve 112 may be omitted, thus leaving opening 96 uncovered. In this case, exhaust blower 100 must have sufficient capacity to draw fluid from washing chamber 20 when valve 102 is in an open position.

Valve 102 is preferably a mechanically-actuated flap valve that is controlled by an electronic control unit (not shown). In this regard, an actuator 120 and an associated linkage 122 move valve 102 between open and closed positions. In a preferred embodiment, actuator 120 is a piston/cylinder. The electronic control unit transmits signals to operate actuator 120. Alternatively, valve 102 could be replaced with a pressure-actuated valve, such as those used for valves 62, 72 and 112. In this alternative embodiment, actuator 120 is not required. It should be appreciated that other types of gate elements, well known to those skilled in the art, are also suitable for use in connection with the present invention.

One or more valves 62 are disposed in housing 52 to control the flow of air from the surrounding environment into heating chamber 54. In this regard, valves 62 are deposed relative to openings 66 formed in housing 52, and are movable between a closed position, wherein valves 62 cover and seals openings 66 preventing flow therethrough, and an open position allowing air flow through openings 66.

Valve 72 is disposed in conduit 24 to control the flow of fluid into washing chamber 20. It should be understood that valve 72 is preferably directional, to allow fluid flow into washing chamber 20, and prevent fluid flow out of washing chamber 20 into heating chamber 54. Thus, valve 72 prevents filter element 60 from being contaminated by fluids from washing chamber 20, in the event of a positive pressure condition therein.

Valve 102 is disposed in conduit 82 to control the flow of fluid exiting washing chamber 20. Valve 112 is disposed in exhaust housing 92 to control the flow of fluid out of exhaust chamber 94. In this regard, valve 112 seals opening 96 formed in housing 92, and is movable between open and closed positions. The operation of valves 62, 72, 102, and 112 will be described in detail below.

Figure 3:
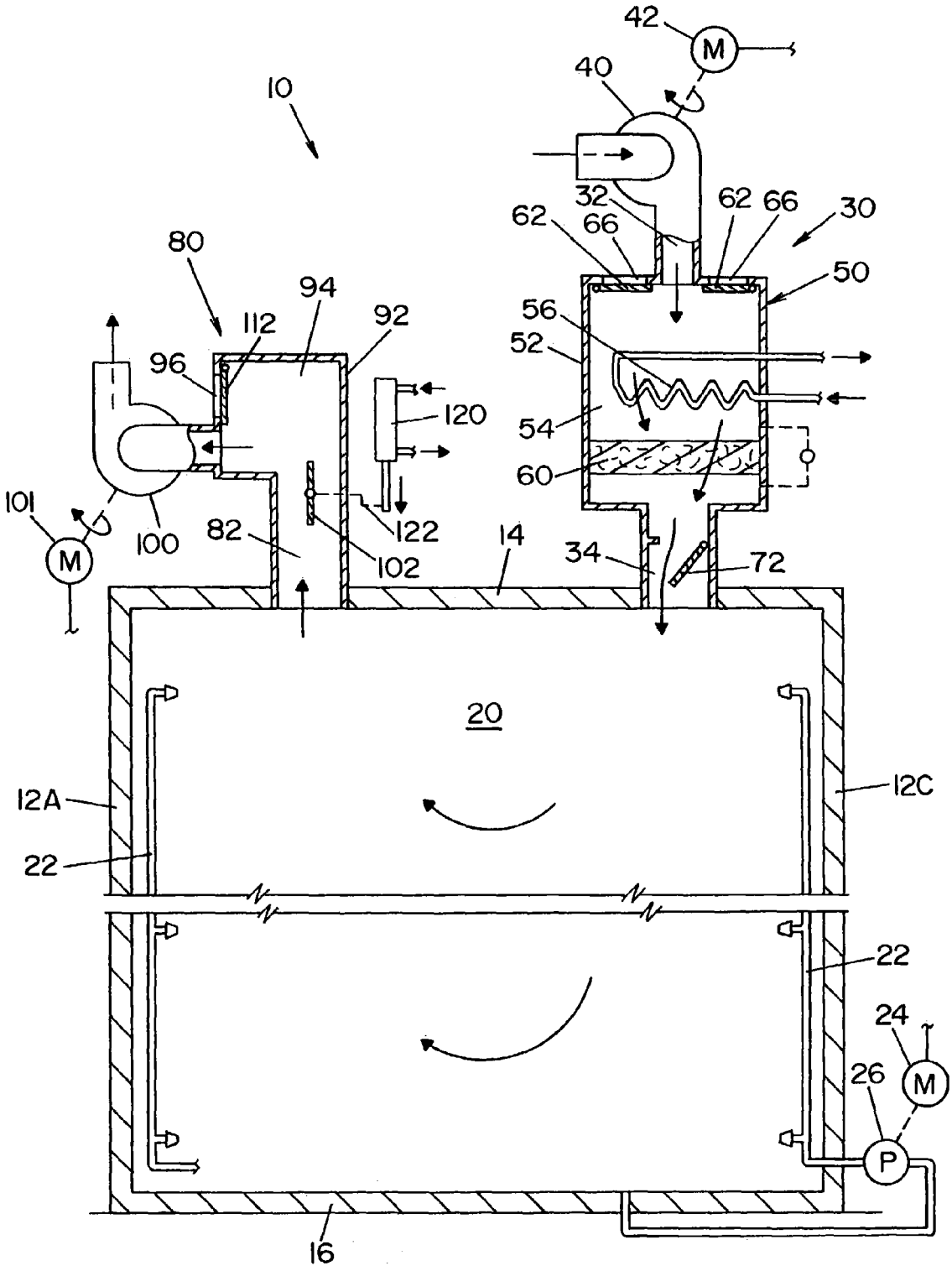
FIG. 3 is a cross-sectional schematic view of the washer system during a drying cycle.

Operation of the pressure equalization system during a drying cycle will now be described with reference to FIG. 3. In a drying cycle, heated air is circulated through washing chamber 20 (following washing and rinsing cycles). Accordingly, blower 40 is activated to draw air from the environment surrounding washer 10 and blow the air through heating chamber 54 and into washing chamber 20. In this regard, air passes through conduit 32 into heating chamber 54. Heating element 56 heats the air inside heating chamber 54. As the heated air passes through filter element 60, contaminants are removed from the air. The air pressure applied by blower 40 moves valve 72 to an open position during the drying cycle. Accordingly, filtered air passes through conduit 34 into washing chamber 20. The air circulates through washing chamber 20 to effect drying of articles inside therein.

Operation of blower 40 increases the pressure inside washing chamber 20. Accordingly, valve 102 moves to an open position, and exhaust blower 100 is activated. As a result, fluid (primarily air) is drawn out of washing chamber 20 by exhaust blower 100. In this regard, fluid is drawn out of washing chamber 20, and passes through conduit 82 and exhaust chamber 94, into the input of blower 100. Blower 100 exhausts the fluid into the surrounding environment. It should be appreciated that valve 102 is operable to move to an open position where: (a) a pressure sensing device senses a positive pressure inside washing chamber 20, and/or (b) the electronic control unit is programmed to open valve 102 during predetermined operating conditions or operating cycles.

For example, a positive pressure condition may also arise in washing chamber 20 due to the introduction of hot fluids into washing chamber 20 through plumbing network 22. The hot fluids will cause expansion of the air inside washing chamber 20. In response to the positive pressure condition, valve 102 is moved to an open position, and exhaust blower 100 is activated, as in the manner as described above.

Figure 4:
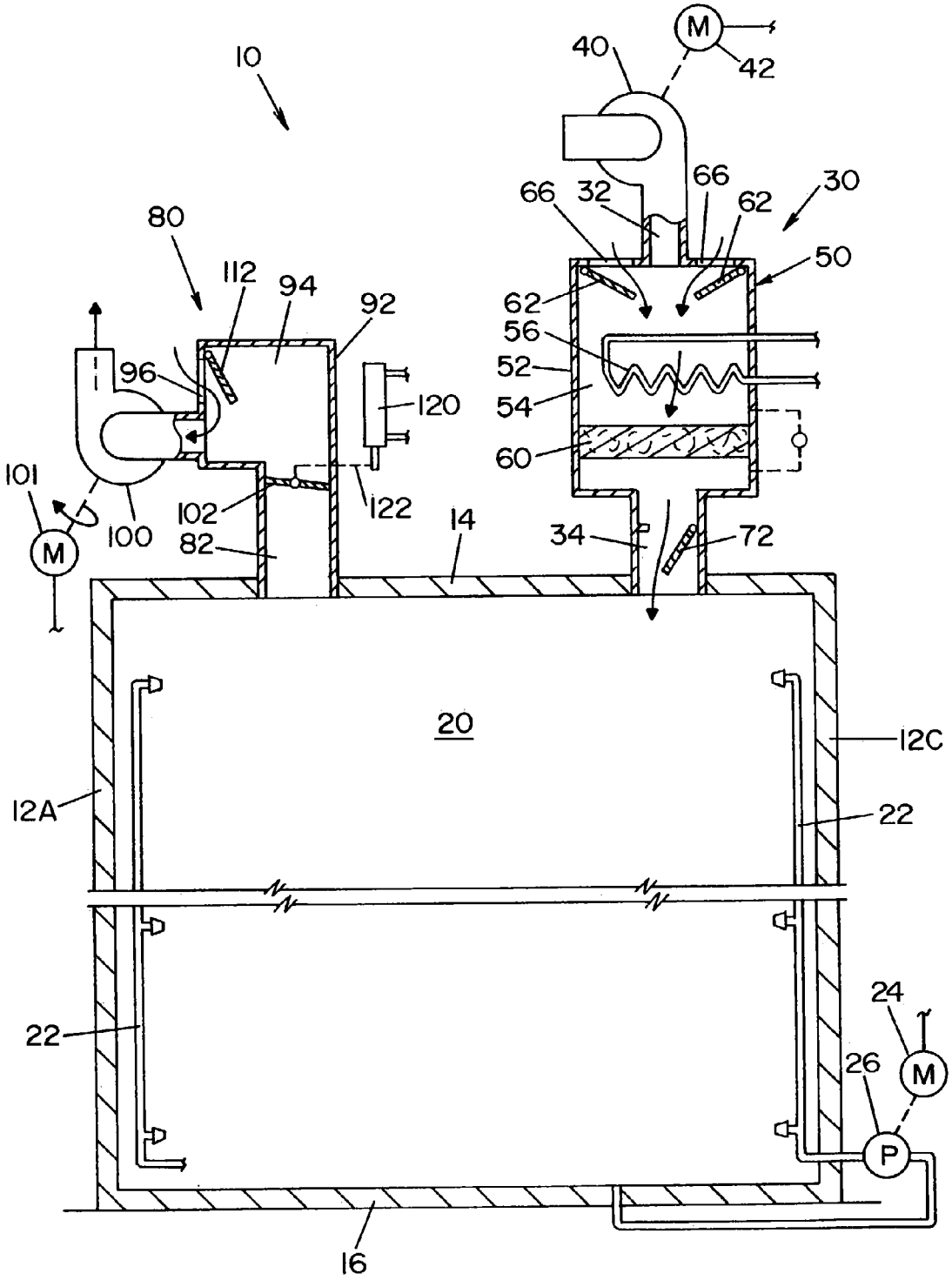
FIG. 4 is a cross-sectional schematic view of the washer responding to a negative pressure condition in the washing chamber.

Operation of the pressure equalization system in response to a negative pressure condition in washing chamber 20 will now be described with reference to FIG. 4. A negative pressure condition (i.e., vacuum) may occur in washing chamber 20 due to variation in temperatures of fluids inside washing chamber 20. For example, a negative pressure condition may arise in washing chamber 20 due to the introduction of lower temperature fluids into washing chamber 20, through plumbing network 22. The lower temperature fluids will cause contraction of the air inside washing chamber 20. In the event of a negative pressure condition in washing chamber 20 when blower 40 is deactivated (e.g., during a washing cycle), valves 62 and 72 move to the open position. When valves 62 move to an open position, air from the surrounding environment is drawn into heating chamber 54 through openings 66. The air passes through filter element 60 to remove contaminants. Thereafter, the air passes through conduit 34 into washing chamber 20 to regulate the pressure therein.

Valve 102 will remain in a closed position during a negative pressure condition inside washing chamber 20. Therefore, if blower 100 is active during a negative pressure condition inside washing chamber 20, valve 12 moves to an open position to prevent a vacuum condition inside exhaust chamber 94. A vacuum condition in exhaust chamber 94 may cause excessive wear of the components of blower 100. Air from the surrounding environment is drawn into exhaust chamber 94, through opening 96, and into the input of blower 100. Blower 100 exhausts the air inside exhaust chamber 94 back into the surrounding environment.

In accordance with another aspect of the present invention, recirculation pump 26 includes a variable frequency drive that gradually increases pump speed from a slow pump speed to a nominal pump speed, upon activation of pump 26. In this regard, pump 26 has a "progressive start" that gradually increases the operating speed of the pump, thereby preventing the occurrence of a rapid positive or negative pressure condition inside washing chamber 20.

The pressure equalization system of the present invention allows washer 10 to operate without any limitation on the sequence of operating cycles. In this regard, the pressure equalization system adapts to current operating conditions by responding to positive or negative pressure conditions occurring in washing chamber 20.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A washer comprising:

a washing chamber dimensioned to receive articles to be washed;

an intake assembly having a first blower and a first chamber fluidly connectable with the washing chamber;

plumbing to deliver a fluid to the washing chamber; and a pressure equalization system operable to maintain an equalized pressure in the washing chamber, said pressure equalization system including:

a heating element disposed in the first chamber to heat air therein;

a first gate element movable between an open position and a closed position, said first gate element disposed between said first blower and said washing chamber for controlling fluid flow between the first chamber and the washing chamber, wherein said first gate clement moves to the open position when said first blower is activated; and a second gate element disposed in the first chamber and movable between an open position and a closed position to control air flow into the first chamber from the environment surrounding the washer, said second gate element located between said first blower and said first gate element, wherein said first gate element and said second gate element move to the open position in response to a negative pressure condition in said washing chamber to increase the pressure therein.

2. The washer of claim 1, wherein said first and second gate elements are pressure-actuated flap valves.

3. The washer of claim 1, wherein a filter element is disposed in said first chamber to filter air before the air passes into said washing chamber.

4. The washer of claim 1, wherein said pressure equalization system includes a third gate element movable between an open position and a closed position, said third gate element movable to the open position when there is a positive pressure condition inside said washing chamber, to allow fluid to exit said washing chamber.

5. The washer of claim 4, wherein said third gate element is a mechanically-operated flap valve.

6. The washer of claim 4, wherein said washer further comprises an exhaust assembly for exhausting fluids from said washing chamber, said exhaust assembly including a second blower, wherein said third gate element is disposed between said washing chamber and the second blower.

7. The washer of claim 6, wherein said exhaust assembly includes an exhaust chamber and a fourth gate element movable between an open position and a closed position, said fourth gate element moving to the open position in response to a negative pressure condition in said exhaust chamber.

8. The washer of claim 7, wherein said fourth gate element is a pressure-actuated flap valve.

9. The washer of claim 6, wherein said exhaust assembly comprises an exhaust chamber including an opening for drawing fluid therein to prevent a negative pressure condition in said exhaust chamber.

10. The washer of claim 1, wherein said washer further comprises a recirculation pump having a frequency variator that gradually increases pump speed from a slow pump speed to a nominal pump speed, upon activation of the recirculation pump.

* * * * *